US010094606B2

(12) United States Patent
Fox et al.

(10) Patent No.: US 10,094,606 B2
(45) Date of Patent: Oct. 9, 2018

(54) WATER TEMPERATURE SENSOR IN A BRAZED PLATE HEAT EXCHANGER

(71) Applicant: TRANE INTERNATIONAL INC., Davidson, NC (US)

(72) Inventors: William B. Fox, Onalaska, WI (US); Dwayne L. Johnson, La Crescent, MN (US); Markham G. Chatterton, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 82 days.

(21) Appl. No.: 15/212,553

(22) Filed: Jul. 18, 2016

(65) Prior Publication Data

US 2016/0327324 A1 Nov. 10, 2016

Related U.S. Application Data

(62) Division of application No. 13/200,584, filed on Sep. 26, 2011, now Pat. No. 9,395,125.

(51) Int. Cl.
*F25D 17/00* (2006.01)
*F25B 49/02* (2006.01)
(Continued)

(52) U.S. Cl.
CPC ..... *F25B 49/022* (2013.01); *F28D 9/005* (2013.01); *F28F 27/00* (2013.01);
(Continued)

(58) Field of Classification Search
CPC ..... F25B 2700/2116; F25B 49/022; F28D 9/005; F28F 2265/14; F28F 2275/04; F28F 27/00
(Continued)

(56) References Cited

U.S. PATENT DOCUMENTS 3,696,636 A 10/1972 Mille
4,177,859 A 12/1979 Gatti et al.
(Continued)

OTHER PUBLICATIONS

Plate Heat Exchanger: How does it Work, Nov. 14, 2000.*
Plate Heat Exchanger, Nov. 2000.

*Primary Examiner* — Henry Crenshaw
(74) *Attorney, Agent, or Firm* — Hamre, Schumann, Mueller & Larson, P.C.

(57) ABSTRACT

To continue operating a compression refrigerant system even while the system's brazed plate heat exchanger contains, in localized areas, water at or below its atmospheric subfreezing water temperature, a penetrating temperature probe senses the water temperature at a strategic intermediate point between the heat exchanger's water inlet and outlet. The brazed plate heat exchanger comprises a series of corrugated plates stacked and brazed together to create an alternating arrangement of water and refrigerant passages in heat transfer relationship with each other. In some examples, the idea is to take advantage of the principle that water has a lower freezing temperature at relatively high pressure and that the relatively small micro-channel passages of intermediate water passages within the brazed plate heat exchanger can withstand appreciably higher pressure than other areas within the heat exchanger, such as the areas at the heat exchanger's water inlet and water outlet.

7 Claims, 4 Drawing Sheets

(51) Int. Cl.
*F28F 27/00* (2006.01)
*F28D 9/00* (2006.01)

(52) U.S. Cl.
CPC ... *F25B 2700/2116* (2013.01); *F28F 2265/14* (2013.01); *F28F 2275/04* (2013.01)

(58) Field of Classification Search
USPC ..... 62/177
See application file for complete search history.

(56) References Cited

U.S. PATENT DOCUMENTS 4,182,411 A 1/1980 Sumitomo et al.
4,348,870 A 9/1982 Stein et al.
4,385,658 A 5/1983 Leonard
4,416,323 A * 11/1983 Evens ..... F28B 9/005 116/101
4,456,024 A * 6/1984 Roberts ..... E03B 7/12 137/62
4,477,687 A 10/1984 Finney
4,971,137 A 11/1990 Thompson
5,060,600 A 10/1991 Brown et al.
5,129,731 A * 7/1992 Ballin ..... G01K 11/06 116/217
5,139,044 A * 8/1992 Otten ..... A01G 25/16 137/62
5,226,474 A 7/1993 Hallgren
5,355,691 A * 10/1994 Sullivan ..... F04D 27/0261 415/17
5,694,776 A 12/1997 Sahm
5,913,361 A 6/1999 Engstrom et al.
6,244,058 B1 * 6/2001 Duga ..... F25B 39/02 62/177
6,571,548 B1 * 6/2003 Bronicki ..... F01K 23/10 60/39.181
6,817,408 B2 * 11/2004 Lines ..... F25B 25/005 165/231
8,550,368 B2 10/2013 Butler et al.
2003/0205371 A1 11/2003 Lines et al.
2005/0155749 A1 7/2005 Memory et al.
2005/0193750 A1 * 9/2005 Carter ..... F28C 1/14 62/171
2007/0131715 A1 6/2007 Minard et al.
2008/0109337 A1 * 5/2008 Dencer ..... G06Q 40/00 705/35
2009/0126399 A1 5/2009 Takegami
2009/0241577 A1 * 10/2009 Fukushima ..... F25B 13/00 62/259.1
2010/0127017 A1 5/2010 Biesheuvel
2010/0263823 A1 10/2010 Mitsuhashi et al.

* cited by examiner

WATER TEMPERATURE SENSOR IN A BRAZED PLATE HEAT EXCHANGER

BACKGROUND OF THE INVENTION

1. Field of the Invention

The subject invention generally pertains to brazed plate heat exchangers and more specifically to a means for sensing the temperature of water flowing through such heat exchangers.

2. Description of Related Art

Brazed plate heat exchangers basically comprise a plurality of corrugated plates stacked and brazed together to create an alternating arrangement of water and refrigerant passages in heat transfer relationship with each other. Examples of such heat exchangers are disclosed in U.S. Pat. Nos. 4,182,411; 5,226,474 and 5,913,361.

SUMMARY OF THE INVENTION

It is an object of some embodiments of the invention to continue operating or delay the deactivation of a refrigerant compression system even though the water temperature within the system's brazed plate heat exchanger dips below a subfreezing temperature.

It is an object of some embodiments to continue operating or delay the deactivation of a refrigerant compression system even though the water temperature within the system's brazed plate heat exchanger dips only momentarily below a predetermined lower temperature limit.

It is an object of some embodiments to continue operating or delay the deactivation of a refrigerant compression system until the water temperature within the system's brazed plate heat exchanger falls below a predetermined lower temperature limit for a predetermined duration.

It is an object of some embodiments to continue operating or delay the deactivation of a refrigerant compression system until the water temperature within the system's brazed plate heat exchanger falls a predetermined number of times below a predetermined lower temperature limit over a predetermined length of time.

It is an object of some embodiments to monitor the water temperature within a brazed plate heat exchanger at a target point that can withstand appreciably higher pressure than a water inlet or outlet of the heat exchanger.

In some embodiments, the present invention provides a brazed plate heat exchanger that includes a water inlet, a water outlet, a refrigerant inlet and a refrigerant outlet. The brazed plate heat exchanger conveys a current of water from the water inlet to the water outlet, conveys a refrigerant from the refrigerant inlet to the refrigerant outlet, and places the refrigerant in heat transfer relationship with the current of water. The brazed plate heat exchanger includes a plurality of corrugated plates stacked to define a plurality of refrigerant passages that place the refrigerant inlet in fluid communication with the refrigerant outlet. The plurality of corrugated plates are stacked also to further define a plurality of upstream water passages, a plurality of downstream water passages, and a plurality of intermediate water passages. With respect to water flow, the plurality of upstream water passages are downstream of the water inlet, the plurality of intermediate water passages are downstream of the plurality of upstream water passages, the plurality of downstream water passages are downstream of the plurality of intermediate water passages, and the water outlet is downstream of the plurality of downstream water passages. The brazed plate heat exchanger also includes a probe comprising a temperature sensor extending into at least one intermediate water passage of the plurality of intermediate water passages.

In some embodiments, the present invention provides a brazed plate heat exchanger that defines a water inlet, a water outlet, a refrigerant inlet and a refrigerant outlet. The brazed plate heat exchanger conveys a current of water from the water inlet to the water outlet; conveys a refrigerant from the refrigerant inlet to the refrigerant outlet, and places the refrigerant in heat transfer relationship with the current of water. The brazed plate heat exchanger includes a plurality of corrugated plates stacked to define a plurality of refrigerant passages that place the refrigerant inlet in fluid communication with the refrigerant outlet. The plurality of corrugated plates are stacked to further define a plurality of upstream water passages, a plurality of downstream water passages, and a plurality of intermediate water passages. With respect to water flow, the plurality of upstream water passages are downstream of the water inlet, the plurality of intermediate water passages are downstream of the plurality of upstream water passages, the plurality of downstream water passages are downstream of the plurality of intermediate water passages, and the water outlet is downstream of the plurality of downstream water passages. The current of water at the water inlet is warmer than the current of water at the water outlet, and the current of water at the water outlet is warmer than at least some of the current of water flowing through the plurality of intermediate water passages. The brazed plate heat exchanger also includes a probe comprising a temperature sensor and a pair of wires connected thereto. The temperature sensor is at a tip of the probe and extends into at least one intermediate water passage of the plurality of intermediate water passages. The brazed plate heat exchanger also includes a target point within the plurality of intermediate water passages. The temperature sensor is positioned at the target point. The water at the target point is colder there than at the water inlet, at the plurality of upstream water passages, at the plurality of downstream water passages, and at the water outlet.

In some embodiments, the present invention provides a brazed plate heat exchanger that includes a water inlet, a water outlet, a refrigerant inlet and a refrigerant outlet. The brazed plate heat exchanger conveys a current of water from the water inlet to the water outlet, conveys a refrigerant from the refrigerant inlet to the refrigerant outlet, and places the refrigerant in heat transfer relationship with the current of water. The brazed plate heat exchanger includes a plurality of corrugated plates stacked to define a plurality of refrigerant passages that place the refrigerant inlet in fluid communication with the refrigerant outlet. The plurality of corrugated plates being stacked also to further define a plurality of upstream water passages, a plurality of downstream water passages, and a plurality of intermediate water passages. With respect to water flow, the plurality of upstream water passages are downstream of the water inlet, the plurality of intermediate water passages are downstream of the plurality of upstream water passages, the plurality of downstream water passages are downstream of the plurality of intermediate water passages, and the water outlet is downstream of the plurality of downstream water passages. The current of water at the water inlet is warmer than the current of water at the water outlet, and the current of water at the water outlet is warmer than at least some of the current of water flowing through the plurality of intermediate water passages. At least some corrugated plates of the plurality of corrugated plates extend out to an outer peripheral edge of the brazed plate heat exchanger. The brazed plate heat exchanger also includes a probe comprising a pair of wires and a temperature sensor connected thereto. The temperature sensor is at a tip of the probe. The probe penetrates at least one corrugated plate of the plurality of corrugated plates. The probe penetrates the outer peripheral edge of the brazed plate heat exchanger. The temperature sensor extends into at least one intermediate water passage of the plurality of intermediate water passages. The brazed plate heat exchanger also includes a target point within the plurality of intermediate water passages. The temperature sensor is positioned at the target point. The water at the target point is colder there than at the water inlet, at the plurality of upstream water passages, at the plurality of downstream water passages, and at the water outlet.

In some embodiments, the present invention provides a control method involving a temperature sensor disposed within a heat exchanger that conveys refrigerant and water, wherein the water has an atmospheric freezing point temperature at atmospheric pressure. The control method includes defining a lower temperature limit that is below the atmospheric freezing point temperature. The temperature sensor senses the temperature of the water within the heat exchanger. The temperature sensor provides a feedback signal responsive to the temperature of the water. The control method further includes conveying the feedback signal to a controller. In response to the feedback signal, the controller distinguishes between an acceptable operation and an unacceptable operation. The unacceptable operation is the temperature of the water being below the lower temperature limit. The acceptable operation is the temperature of the water being above the lower temperature limit. The acceptable operation includes the temperature of the water being between the atmospheric freezing point temperature and the lower temperature limit.

In some embodiments, the present invention provides a control method involving a temperature sensor disposed within a heat exchanger that conveys refrigerant and water. The heat exchanger has a water outlet. The water has an atmospheric freezing point temperature at atmospheric pressure. The control method includes defining a lower temperature limit. The temperature sensor senses the temperature of the water within the heat exchanger. The temperature sensor provides a feedback signal responsive to the temperature of the water. The control method further includes conveying the feedback signal to a controller. In response to the feedback signal, the controller distinguishes between an acceptable operation and an unacceptable operation. The unacceptable operation is the water temperature falling below the lower temperature limit a predetermined number of times, wherein the predetermined number of times is greater than one. The acceptable operation is the water temperature falling below the lower temperature limit less than the predetermined number of times. The acceptable operation includes the water temperature falling just once below the lower temperature limit.

In some embodiments, the present invention provides a control method involving a temperature sensor disposed within a heat exchanger that conveys refrigerant and water. The heat exchanger defines a water outlet. The water has an atmospheric freezing point temperature at atmospheric pressure. The control method includes defining a lower temperature limit. The temperature sensor senses the temperature of the water within the heat exchanger. The temperature sensor provides a feedback signal responsive to the temperature of the water. The control method further includes conveying the feedback signal to a controller. In response to the feedback signal, the controller distinguishes between an acceptable operation and an unacceptable operation. The unacceptable operation is the water temperature being below the lower temperature limit longer than a predetermined period. The acceptable operation is the water temperature being greater than the lower temperature limit for less than the predetermined period.

DESCRIPTION OF THE PREFERRED EMBODIMENT

Figure 1:
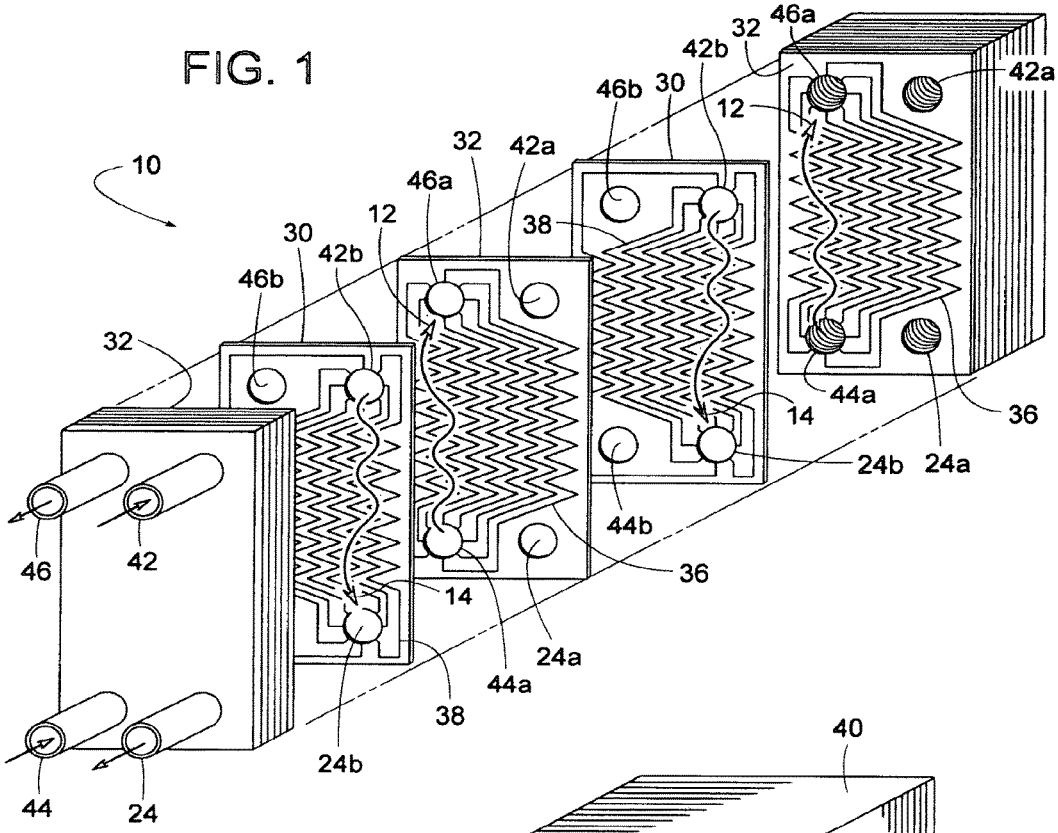
FIG. 1 is an exploded view of an example brazed plate heat exchanger.

FIGS. 1-5 show an example of a brazed plate heat exchanger 10 that uses a refrigerant 12 to cool a current of water 14. Examples of the term, "water" include pure water and mixtures containing at least some water. A water temperature probe 16 is strategically positioned within heat exchanger 10 to help achieve and monitor operation at water temperatures that are almost at or even slightly below the temperature at which water at atmospheric pressure normally freezes. In some examples, a temperature sensor 18 at a tip 20 (FIG. 2) of probe 16 senses water 14 at a target point (e.g., at target points 22*a*, 22*b*, 22*c* or 22*d*) where water 14 is colder than it is at a chilled water outlet 24 of heat exchanger 10. Temperature sensor 18 is schematically illustrated to represent any temperature responsive device examples of which include, but are not limited to, a temperature transducer, a bi-metallic switch, PTC thermistor, NTC thermistor, thermocouple, resistance temperature detector, etc.

To make use of the sensed temperature, probe 16 includes a pair of wires 26 (two or more wires) that convey a water temperature feedback signal 28 to a controller 50 (FIG. 5) associated with heat exchanger 10. Controller 50 is schematically illustrated to represent any electrical circuit that provides one or more outputs in response to one or more inputs. Examples of controller 50 include, but are not limited to, a computer, microprocessor, integrated circuit(s), programmable logic controller (PLC), electromechanical relays, and various combinations thereof.

In the illustrated example, heat exchanger 10 comprises a plurality of corrugated plates 30 and 32 disposed along substantially parallel planes (e.g., plurality of first and second planes) and being stacked in an alternating arrangement. In some examples, plates 30 and 32 are made of stainless steel sheet metal clad or otherwise coated with a thin layer of braze material 34 (e.g., copper or copper alloy) that provides a joining interface of braze material 34 at contact points between adjacent plates 30 and 32. For assembly, plates 30 and 32 are temporarily clamped together and heated to permanently braze plates 30 and 32 together to create alternating layers of a plurality of refrigerant passages 36 and a plurality of water passages 38 between adjacent plates 30 and 32. The brazing operation hermetically isolates water passages 38 from refrigerant passages 36 and hermetically seals an outer peripheral edge 40 of plates 30 and 32.

The actual design of plates 30 and 32 may vary to provide an infinite number of heat exchanger configurations with any number of passes and flow patterns. For clear illustration, heat exchanger 10 is shown having one each of a water inlet 42, water outlet 24, a refrigerant inlet 44 and a refrigerant outlet 46. Each plate 32 includes a refrigerant supply opening 44*a*, a refrigerant return opening 46*a*, a water supply opening 42*a* and a water return opening 24*a*. Likewise, each plate 30 includes a refrigerant supply opening 44*b*, a refrigerant return opening 46*b*, a water supply opening 42*b* and a water return opening 24*b*.

In use, relatively cold refrigerant 36 enters heat exchanger 10 through refrigerant inlet 44 and flows through refrigerant supply openings 44*a* and 44*b*. In some examples, the cold refrigerant 36 is from a conventional refrigerant compression system 48 (e.g., an air conditioner, a heat pump, etc.) of which heat exchanger 10 functions as an evaporator. Openings 44*a* of heat exchanger 10 deliver refrigerant 36 to refrigerant passages 36, which convey the refrigerant in a zigzag and/or otherwise convoluted pattern between adjacent plates 30 and 32 to refrigerant return openings 46*a*. Openings 46*a* and 46*b* then direct the refrigerant to outlet 46 to recycle refrigerant 36 through system 48.

Water 14 to be cooled enters heat exchanger 10 through inlet 42 and flows through water supply openings 42*a* and 42*b*. Openings 42*b* of heat exchanger 10 deliver water 14 to water passages 38, which convey the water in a zigzag and/or otherwise convoluted pattern between other adjacent plates 30 and 32 to water return openings 24*b*. As water 14 flows through water passages 38, refrigerant 12 in adjacent passages 36 cool the water. After refrigerant 12 cools water 14, openings 24*a* and 24*b* direct the chilled water 14 to water outlet 24, which delivers the chilled water 14 to wherever it may be needed.

Figure 3:
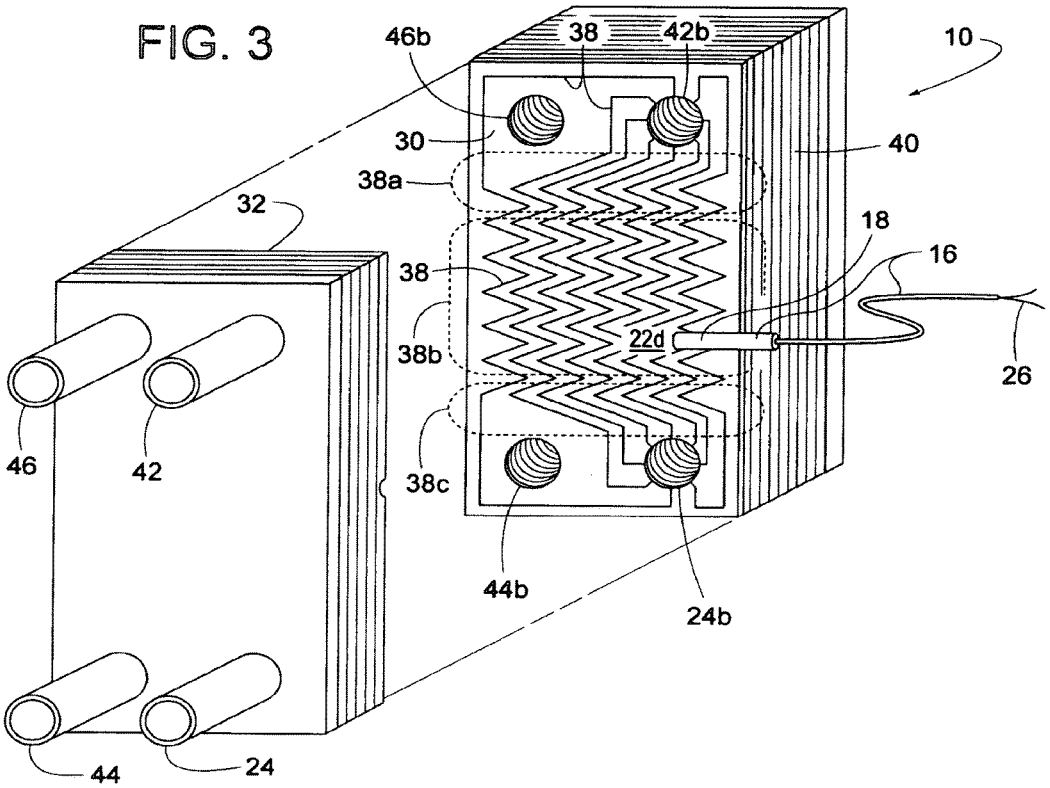
FIG. 3 is an exploded view of the brazed plate heat exchanger showing an example temperature probe position.

In some examples, due to the convoluted interrelated flow patterns created by passages 36 and 38, water 14 reaches its lowest temperature at some point downstream of water inlet 42 and upstream of water outlet 24. Referring to FIG. 3, the plurality of water passages 38 between adjacent plates 30 and 32 include a plurality of upstream water passages 38*a*, a plurality of downstream water passages 38*c*, and a plurality of intermediate water passages 38*b* therebetween. Thus, water 14 flows sequentially from water inlet 42, through water supply opening 42*b*, through upstream water passages 38*a*, through intermediate water passages 38*b*, through downstream water passages 38*c*, through water return opening 24*b*, and through water outlet 24. In the example of FIG. 3, water 14 reaches its lowest temperature at target point 22*d* within intermediate water passages 38*b*, so sensor 18 of probe 16 is positioned at this point 22*d*. Water 14 at target point 22*d* is colder there than at water inlet 42, at upstream water passages 38*a*, at downstream water passages 38*c*, and at water outlet 24. Also, the current of water 14 at water inlet 42 is warmer than the current of water 14 at water outlet 24, and the current of water 14 at water outlet 24 is warmer than at least some of the current of water 14 flowing through the plurality of intermediate water passages 38*b*. In some cases, the location of target point 22*d* is a function of where the two phase refrigerant is at its lowest temperature (lowest pressure when no glide is present) and the lowest flow rate of the water.

Figure 2:
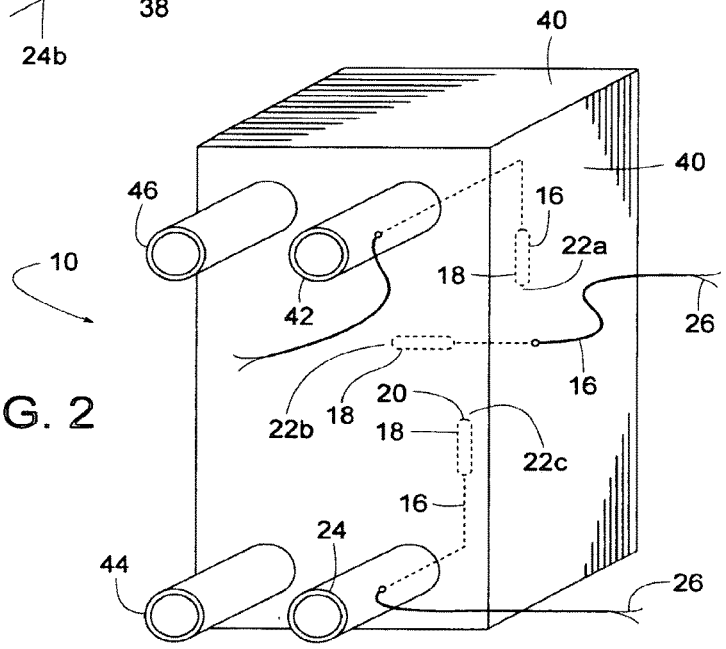
FIG. 2 is a perspective view of the brazed plate heat exchanger illustrating various examples of temperature probe positions.
Figure 4:
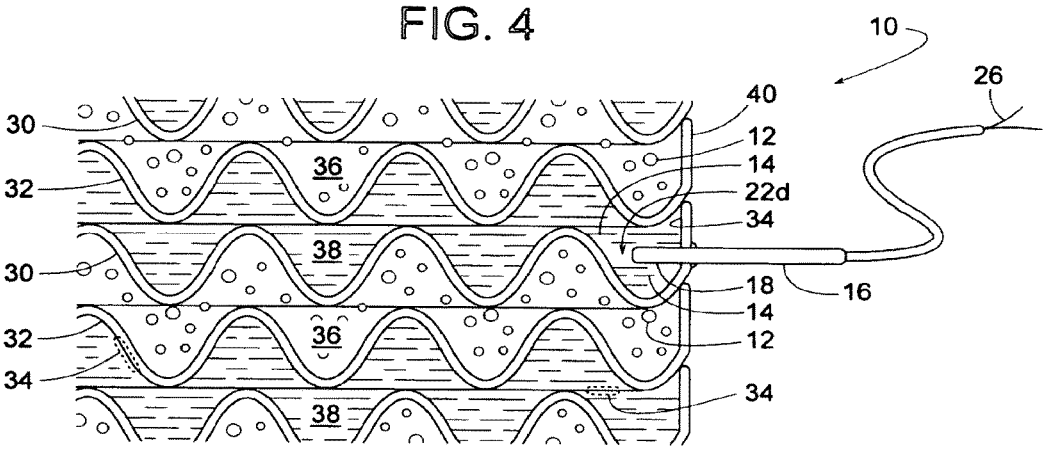
FIG. 4 is a cross-sectional view taken generally along line 4-4 of FIG. 5 showing an example temperature probe position relative to an example brazed plate heat exchanger.
Figure 5:
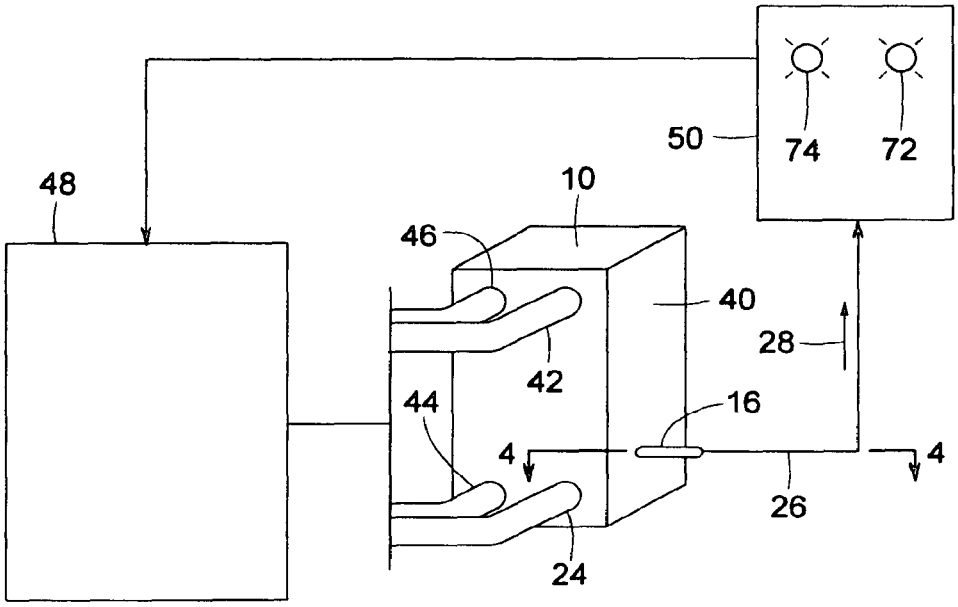
FIG. 5 is a schematic view of the example brazed plate heat exchanger connected to a refrigerant system its controller.

In some examples, to position sensor 18 at target point 22*d*, probe 16 penetrates at least one corrugated plate 30, as shown in FIGS. 3 and 4. In other examples, as shown in FIG. 2, probe 16 passes through water inlet 42 to position sensor 18 at target point 22*a*, passes through water outlet 24 to position sensor 18 at target point 22*c*, penetrates outer peripheral edge 40 to position sensor 18 at target points 22*b* or 22*d*, and/or probe 16 penetrates interface of braze material 34 (e.g., to access points 22*b* and/or 22*d*). In one or more of the foregoing examples, wires 26 convey temperature feedback signal 28 to controller 50, as shown in FIG. 5.

Figure 6:
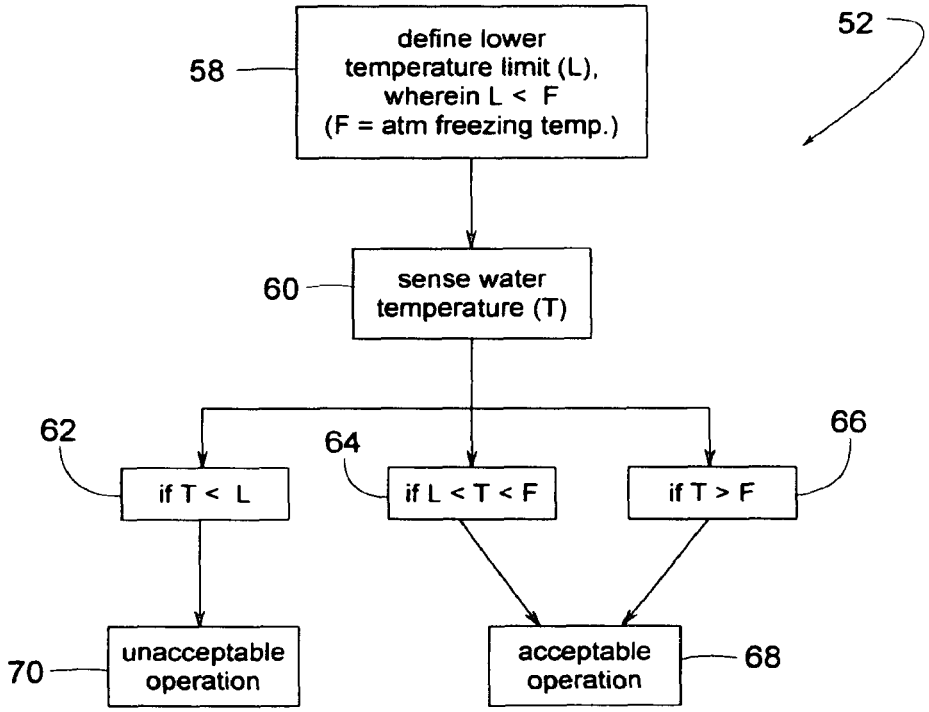
FIG. 6 is a block diagram showing an algorithm and control method.
Figure 7:
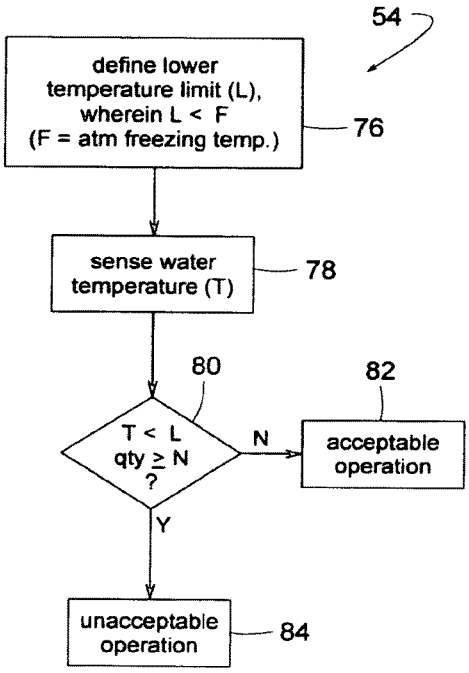
FIG. 7 is a block diagram showing another algorithm and control method.
Figure 8:
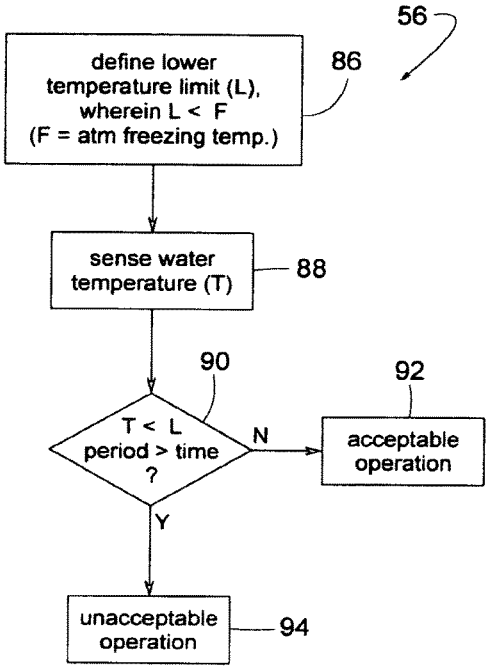
FIG. 8 is a block diagram showing yet another algorithm and control method.
Figure 9:
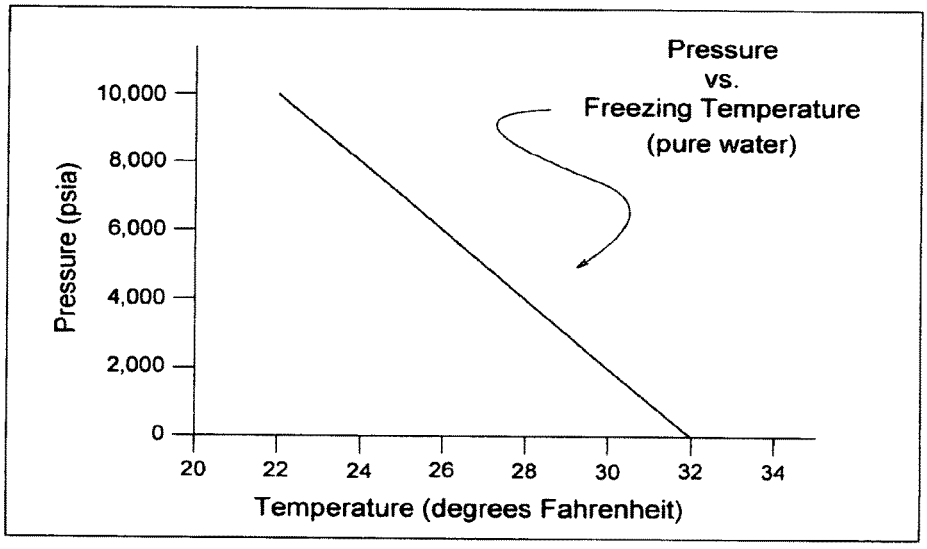
FIG. 9 is a graph showing the relationship between the freezing point of pure water and water pressure.

Various examples of controller 50 operate with temperature sensor 18 according to the control schemes 52, 54 and 56, as illustrated in FIGS. 6, 7 and 8 respectively. In control scheme 52 of FIG. 6, probe 16 monitors the water temperature at a target point (e.g., points 22*a*, 22*b*, 22*c* or 22*d*) within an intermediate water passage 38*b* to determine whether the water temperature is at or above an acceptable subfreezing temperature at that point. The term, "subfreezing" means a temperature that is below a fluid's freezing temperature at atmospheric pressure. In some examples, the idea is to take advantage of the principle that water has a lower freezing temperature at relatively high pressure (see FIG. 9), and that the relatively small micro-channel passages of intermediate water passages 38*b* can withstand appreciably higher pressure than other areas of heat exchanger 10, such as the areas at water inlet 42 and water outlet 24.

In control scheme 52 specifically, block 58 of FIG. 6 represents controller 50 defining a lower temperature limit (e.g., a subfreezing temperature of 31.5 degrees Fahrenheit) that is below the atmospheric freezing point temperature of water 14 (e.g., 32 degrees Fahrenheit). Block 60 represents temperature sensor 18 sensing the temperature of water 14 within heat exchanger 10, providing feedback signal 28 in response to sensing the temperature of water 14, and conveying feedback signal 28 to controller 50. Blocks 62, 64 and 66 represent controller 50 distinguishing between an acceptable operation (block 68) and an unacceptable operation (block 70), wherein the unacceptable operation (block 70) is the temperature of water 14 being below the lower temperature limit (e.g., 31.5 degrees Fahrenheit), and the acceptable operation (block 68) is the temperature of water 14 being above the lower temperature limit. The acceptable operation (block 68) includes the temperature of water 14 being between the atmospheric freezing point temperature (e.g., 32 degrees Fahrenheit) and the lower temperature limit (e.g., 31.5 degrees Fahrenheit). Upon determining acceptable operation, in some examples, controller 50 activates a first indicator 72 (e.g., a green light) that indicates normal operation and/or controls system 48 in some acceptable predetermined manner. Upon determining unacceptable operation, in some examples, controller 50 activates a second indicator 74 (e.g., a red light) and deactivates or otherwise disables system 48. In some examples, upon determining unacceptable operation, controller 50 initiates some predetermined corrective action such as, for example, increasing water flow through heat exchanger 10.

In the example of control scheme 54, of FIG. 7, controller 50 identifies unacceptable operation as being the water temperature at a target point (e.g., point 22*a*, 22*b*, 22*c* or 22*d*) falling below a lower temperature limit (e.g., 29 degrees Fahrenheit, 32 degrees Fahrenheit, 35 degrees Fahrenheit, etc.) a predetermined number of times (e.g., once, twice, . . . , etc.) within a predetermined length of time (e.g., within 5 seconds, within 5 minutes, . . . etc.). In some examples, block 76 of FIG. 7 represents controller 50 defining a lower temperature limit (e.g., a subfreezing temperature of 31.5 degrees Fahrenheit) that is below the atmospheric freezing point temperature of water 14 (e.g., 32 degrees Fahrenheit). Block 78 represents temperature sensor 18 sensing the temperature of water 14 within heat exchanger 10, providing feedback signal 28 in response to sensing the temperature of water 14, and conveying feedback signal 28 to controller 50. Blocks 80, 82 and 84 represent controller 50 distinguishing between an acceptable operation (block 82) and an unacceptable operation (block 84), wherein the unacceptable operation (block 84) is the temperature of water 14 falling below the lower temperature limit a predetermined number of times (represented by the letter "N") within a predetermined length of time, and the acceptable operation (block 82) is the temperature of water 14 not falling below the lower temperature limit the predetermined number of times. Upon determining acceptable operation, in some examples, controller 50 activates first indicator 72 and/or controls system 48 in some acceptable predetermined manner. Upon determining unacceptable operation, in some examples, controller 50 activates second indicator 74 and/or deactivates or otherwise disables system 48.

In the example of control scheme 56, of FIG. 8, controller 50 identifies unacceptable operation as being the water temperature at a target point (e.g., point 22*a*, 22*b*, 22*c* or 22*d*) being below a lower temperature limit (e.g., 29 degrees Fahrenheit, 32 degrees Fahrenheit, 35 degrees Fahrenheit, etc.) for a predetermined length of time (e.g., for 5 seconds, for 5 minutes, . . . etc.). In some examples, block 86 of FIG. 8 represents controller 50 defining a lower temperature limit (e.g., a subfreezing temperature of 31.5 degrees Fahrenheit) that is below the atmospheric freezing point temperature of water 14 (e.g., 32 degrees Fahrenheit). Block 88 represents temperature sensor 18 sensing the temperature of water 14 within heat exchanger 10, providing feedback signal 28 in response to sensing the temperature of water 14, and conveying feedback signal 28 to controller 50. Blocks 90, 92 and 94 represent controller 50 distinguishing between an acceptable operation (block 92) and an unacceptable operation (block 94), wherein the unacceptable operation (block 94) is the temperature of water 14 being below the lower temperature limit for a predetermined length of time, and the acceptable operation (block 92) is the temperature of water 14 not being below the lower temperature limit for the predetermined length of time. Upon determining acceptable operation, in some examples, controller 50 activates first indicator 72 and/or controls system 48 in some acceptable predetermined manner. Upon determining unacceptable operation, in some examples, controller 50 activates second indicator 74 and/or deactivates or otherwise disables system 48.

It should be noted that, the term, "predetermined length of time" is equivalent to the terms, "predetermined time span," "predetermined period," and "predetermined duration." The term, "water outlet" means an exit through which water 14 leaves heat exchanger 10 and does not necessarily mean that the water must escape to atmosphere. The term, "penetrate" and derivatives thereof means extending through, protruding through, etc.

Although the invention is described with respect to a preferred embodiment, modifications thereto will be apparent to those of ordinary skill in the art. The scope of the invention, therefore, is to be determined by reference to the following claims:

The invention claimed is:

1. A control method involving a temperature sensor disposed within a heat exchanger that conveys a refrigerant and water, the water having an atmospheric freezing point temperature at atmospheric pressure, the control method comprising:

defining a lower temperature limit that is below the atmospheric freezing point temperature;

sensing the temperature of the water within the heat exchanger using the temperature sensor, the temperature sensor extending into at least one passage within the heat exchanger, the temperature sensor being positioned at a target point, wherein the water at the target point is colder than the water at an inlet of the heat exchanger, the target point having a lower flow rate of water than the water inlet;

providing a feedback signal from the temperature sensor that is responsive to the temperature of the water;

conveying the feedback signal to a controller; and in response to the feedback signal, the controller distinguishing between an acceptable operation and an unacceptable operation, the unacceptable operation being the temperature of the water being below the lower temperature limit, the acceptable operation being the temperature of the water being above the lower temperature limit.

2. A control method involving a temperature sensor disposed within a heat exchanger that conveys a refrigerant and water, the heat exchanger having a water outlet, the water having an atmospheric freezing point temperature at atmospheric pressure, the control method comprising:

defining a lower temperature limit;

sensing the temperature of the water within the heat exchanger using the temperature sensor, the temperature sensor extending into at least one passage within the heat exchanger, the temperature sensor being positioned at a target point, wherein the water at the target point is colder than the water at an inlet of the heat exchanger, the target point having a lower flow rate of water than the water inlet;

providing a feedback signal from the temperature sensor that is responsive to the temperature of the water;

conveying the feedback signal to a controller; and in response to the feedback signal, the controller distinguishing between an acceptable operation and an unacceptable operation, the unacceptable operation being the water temperature falling below the lower temperature limit a predetermined number of times, the predetermined number of times being greater than one, the acceptable operation being the water temperature falling below the lower temperature limit less than the predetermined number of times.

3. The control method of claim 2, wherein the lower temperature limit is less than the atmospheric freezing point temperature of the water.

4. The control method of claim 2, wherein the lower temperature limit is less than a temperature at which the water would freeze at the water outlet.

5. A control method involving a temperature sensor disposed within a heat exchanger that conveys a refrigerant and water, the heat exchanger defining a water outlet, the water having an atmospheric freezing point temperature at atmospheric pressure, the control method comprising:

defining a lower temperature limit;

sensing the temperature of the water within the heat exchanger using the temperature sensor, the temperature sensor extending into at least one passage within the heat exchanger, the temperature sensor being positioned at a target point, wherein the water at the target point is colder than the water at an inlet of the heat exchanger, the target point having a lower flow rate of water than the water inlet;

providing a feedback signal from the temperature sensor that is responsive to the temperature of the water;

conveying the feedback signal to a controller; and in response to the feedback signal, the controller distinguishing between an acceptable operation and an unacceptable operation, the unacceptable operation being the water temperature being below the lower temperature limit longer than a predetermined period, the acceptable operation being the water temperature being not lower than the lower temperature limit for less than the predetermined period.

6. The control method of claim 5, wherein the lower temperature limit is less than the atmospheric freezing point temperature of the water.

7. The control method of claim 5, wherein the lower temperature limit is less than a temperature at which the water would freeze at the water outlet.

* * * * *